United States Patent [19]

Lonati

[11] Patent Number: 4,790,154

[45] Date of Patent: Dec. 13, 1988

[54] DEVICE FOR SELECTING NEEDLES IN A CIRCULAR KNITTING MACHINE, IN PARTICULAR FOR STOCKINGS

[75] Inventor: Francesco Lonati, Brescia, Italy

[73] Assignee: Lonati S.p.A., Brescia, Italy

[21] Appl. No.: 61,620

[22] Filed: Jun. 15, 1987

[30] Foreign Application Priority Data

Jul. 8, 1986 [IT] Italy ..... 21063 A/86

[51] Int. Cl.[4] ..... D04B 15/78

[52] U.S. Cl. ..... 66/221

[58] Field of Search ..... 66/25, 75.2, 219, 221

[56] References Cited

U.S. PATENT DOCUMENTS 3,908,403 9/1975 Ringrose ..... 66/221

FOREIGN PATENT DOCUMENTS 2711828 9/1978 Fed. Rep. of Germany ..... 66/219
2842054 5/1979 Fed. Rep. of Germany ..... 66/75.2
51-40460 4/1976 Japan ..... 66/75.2
8100730 3/1981 PCT Int'l Appl. ..... 66/75.2

*Primary Examiner*—Wm. Carter Reynolds
*Attorney, Agent, or Firm*—Guido Modiano; Albert Josif

[57] ABSTRACT

The device comprises a plurality of superimposed selection levers, individually pivoted at an intermediate portion thereof to a supporting structure. The selection levers have an end facing the needle-bearing cylinder in the region of the selectors and are oscillable on a plane parallel to the extension of the plurality of selection levers to interfere or not interfere with the heels of the selectors. An actuating lever acts on the other end of each selection lever, is pivoted at an intermediate portion thereof to a frame, and can oscillate on a plane parallel to the plane of oscillation of the selection levers. For the oscillation of the actuating lever, two electromagnets, arranged on opposite sides with respect to the fulcrum of the actuating lever and alternately operable, are employed.

20 Claims, 3 Drawing Sheets

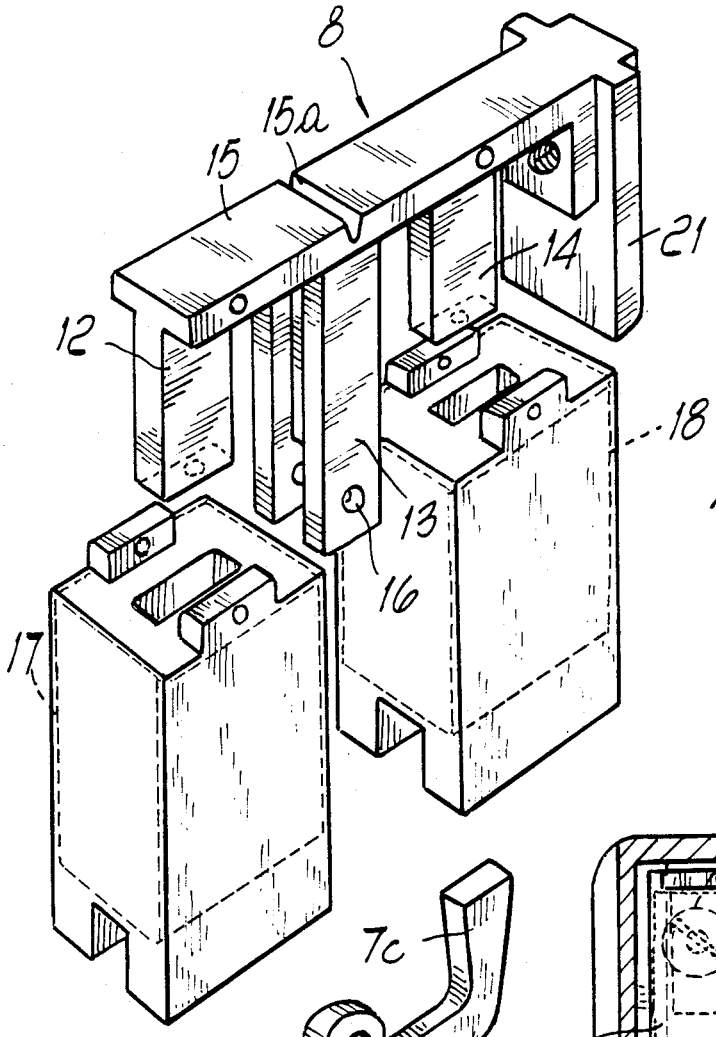
Fig. 5
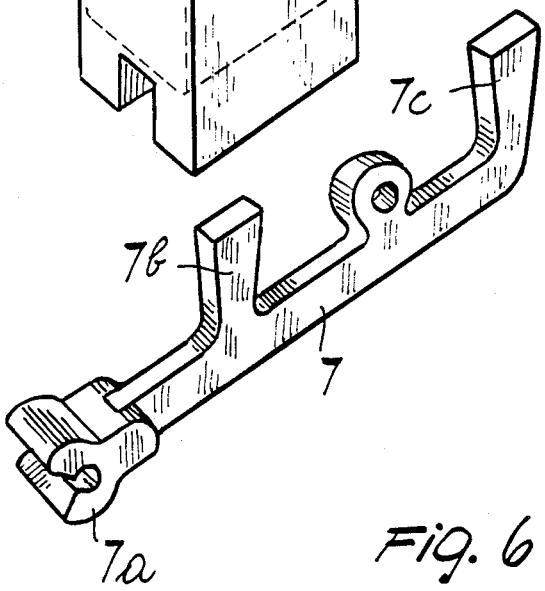
Fig. 6
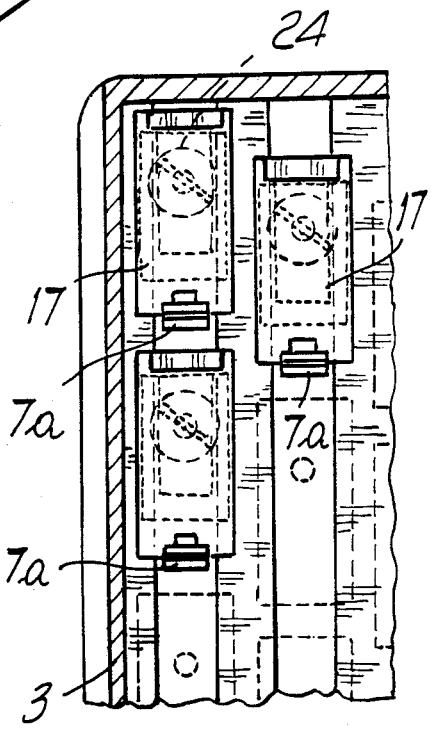

12
15
15a
13
8
14
17
10
IX
IX
7a
21
11
18
7c
7
7b
19
9
20

12
15
15a
13
8
14
17
19
21
10
11
18
7a
7
7b
9
7c
20

17
8
26a
25
22a
23
24
7a
12
13
18
14
26b
22b

DEVICE FOR SELECTING NEEDLES IN A CIRCULAR KNITTING MACHINE, IN PARTICULAR FOR STOCKINGS

BACKGROUND OF THE INVENTION

The present invention relates to a device for selecting needles in a circular knitting machine, in particular for stockings.

Countless devices are known for selecting needles in knitting machines. In particular, a device is known, described in the U.S. patent application Ser. No. 06/916,904 filed on Oct. 7, 1986 by the same applicant. Such a device consists of a plurality of superimposed selection levers which are arranged facing the needlebearing cylinder in the region of the selectors or subneedles. The selection levers are individually pivoted at an intermediate portion thereof to a supporting framework and can oscillate in a plane substantially parallel to the extension of the plurality of levers, that is, parallel to the direction of sliding of the selectors. By virtue of the oscillation of the selection levers it is possible to have their end facing towards the selectors move from a first position, in which this end is at an intermediate level between the heels of the selectors so as to not interfere therewith, to a second position wherein said end is at the level of the heels of the selectors so as to interfere therewith, so as to activate or not activate specific selectors.

For the oscillation of the selection levers, actuating levers are used which are oscillable in a plane substantially parallel to the plane of oscillation of the selection levers and which have one of their ends acting on the end of the selection levers facing in the opposite direction with respect to the selectors.

In order to reduce the dimensions of the actuating levers in a direction parallel to the axis of the needlebearing cylinder of the machine, and to simplify assembly, the end of the selection levers which is coupled to the related actuating lever is in the shape of a flat blade and the related end of the actuating lever is bifurcated to engage said blade on both sides.

For the oscillation of the actuating levers, electromagnets and a permanent magnet, counterposed with respect to the actuating lever, are used. The electromagnet is connected to an electronic machine control element which attracts it according to a preset processing program, while the permanent magnet is used for the return of the actuating lever when the electromagnet is deactivated.

Such a type of device, though it achieves a satisfactory reduction in dimensions and quicker assembly, as well as an excellent operation at medium speeds, has proved to be susceptible to improvements.

With the ever-increasing speeds required in knitting machines, it is in fact desirable to have an actuating lever return speed which is substantially equal to the speed imparted by the electromagnet when it is activated. However, the replacement of the permanent magnet with an electromagnet, keeping the same position, can lead to an interference in magnetic fields if, as required in the case of high operating speeds, the value of the voltage is relatively high.

Furthermore, a presence of a permanent magnet can cause problems during the assembly and the operation of the device, since metallic particles can be attracted between the actuating lever and the permanent magnet, thus reducing the reaction speed of the magnet.

Another problem is due to the fact that when the electromagnet is activated it is necessary to maintain a relatively high voltage in order to overcome the continuous attraction force of the permanent magnet. Since a high voltage causes the overheating of the electromagnet, a very precise setting of the voltage is required in order to avoid damage. Voltage stabilizers are used for this reason.

SUMMARY OF THE INVENTION

The aim of the present invention is to provide a device for selecting needles which can ensure an excellent operation even at very high speeds, while maintaining very small dimensions parallel to the axis of the needlebearing cylinder, to allow the use of short, and therefore lightweight, selectors.

Within the scope of this aim, an object of the invention is to provide a device which ensures in a simple manner high precision and reproducibility of manufacture.

This aim, as well as this and other objects which will become apparent hereinafter, are achieved by a device for selecting needles in a circular knitting machine, in particular for stockings, comprising a plurality of superimposed selection levers, individually pivoted at an intermediate portion thereof to a supporting structure, said selection levers having one of their ends facing the needlebearing cylinder in the region of the selectors and being oscillable in a plane from a first position, whereat said end is at an intermediate level between the heels of the selectors so as to not interfere therewith, to a second position, whereat said end is at the level of the heels of the selectors so as to interfere therewith, an actuating lever being provided for each selection lever, acting on the opposite end of said selection lever with respect to said selectors for the passage from said first position to said second position, characterized in that said actuating lever is pivoted at an intermediate portion thereof to a frame and is controllably oscillable in a plane extension of said plurality of selection levers, and in that it comprises two electromagnets arranged on opposite sides with respect to the fulcrum of said actuating lever, said electromagnets being selectively activatable for causing oscillation of said actuating lever.

BRIEF DESCRIPTION OF THE DRAWINGS

Further features and advantages of the invention will become apparent from the description of a preferred, but not exclusive, embodiment of the device according to the invention, illustrated only by way of non-limitative example in the accompanying drawings, wherein:

FIG. 5 is an enlarged exploded perspective view of an actuating lever with the two electromagnets;

FIG. 6 is a lateral elevation view of some actuating levers with their related electromagnets;

DESCRIPTION OF THE PREFERRED EMBODIMENTS

Figure 1:
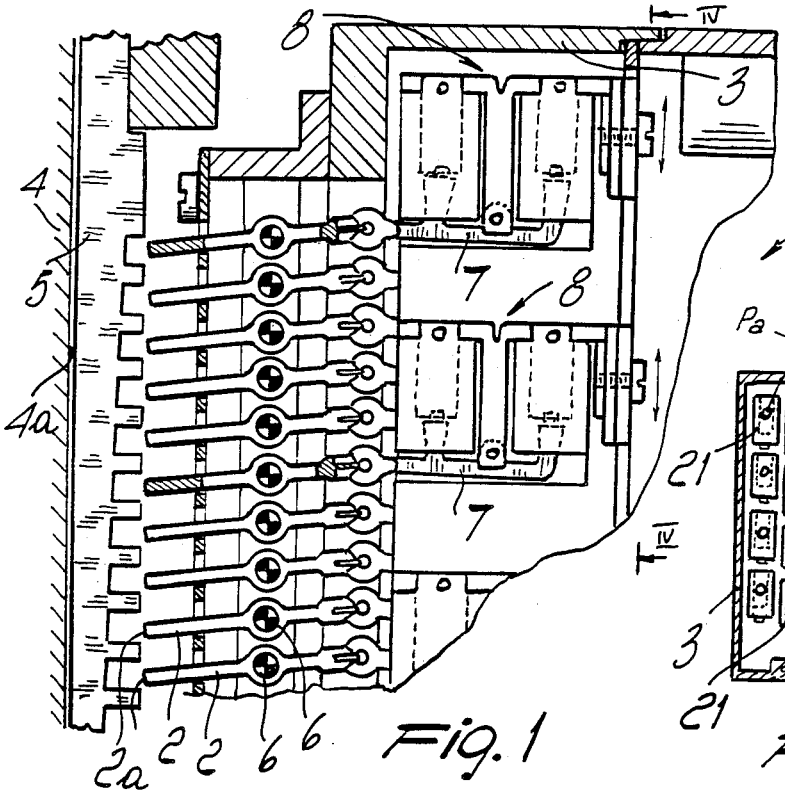
FIG. 1 is a partially cross-sectional lateral elevation view of the device according to the invention.

With reference to the above cited figures, the device according to the invention, generally indicated by the reference numeral 1, comprises a plurality of selection levers 2, superimposed and individually pivoted at an intermediate portion thereof to a supporting framework 3, advantageously made monolithically of ferromagnetic material.

Figure 4:
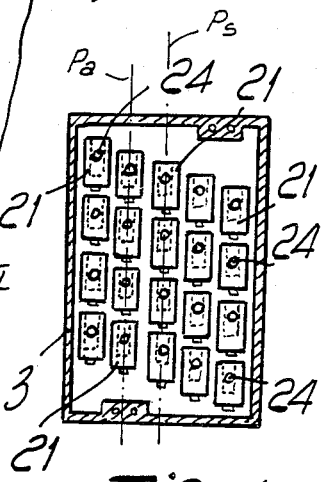
FIG. 4 is a reduced cross section view of FIG. 1 along the axis IV—IV.
Figure 2:
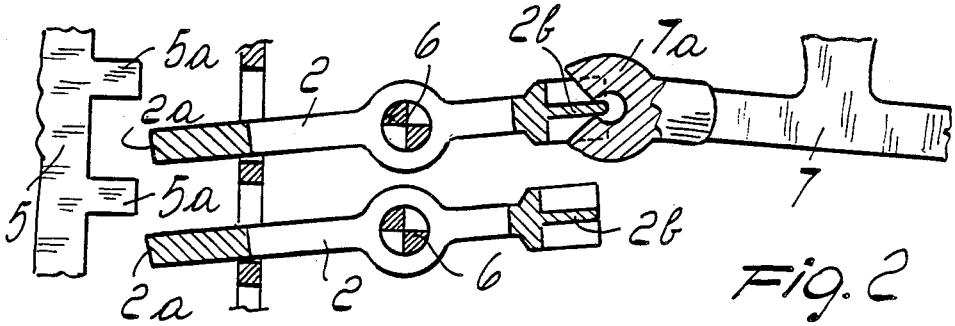
FIG. 2 is an enlarged detail view of FIG. 1 illustrating two selection levers in the first position.
Figure 3:
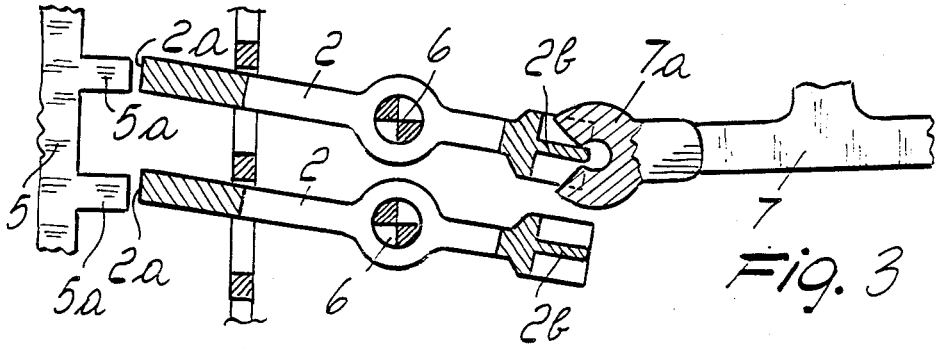
FIG. 3 is an enlarged detail view of FIG. 1 illustrating two selection levers in the second position.
Figure 7:
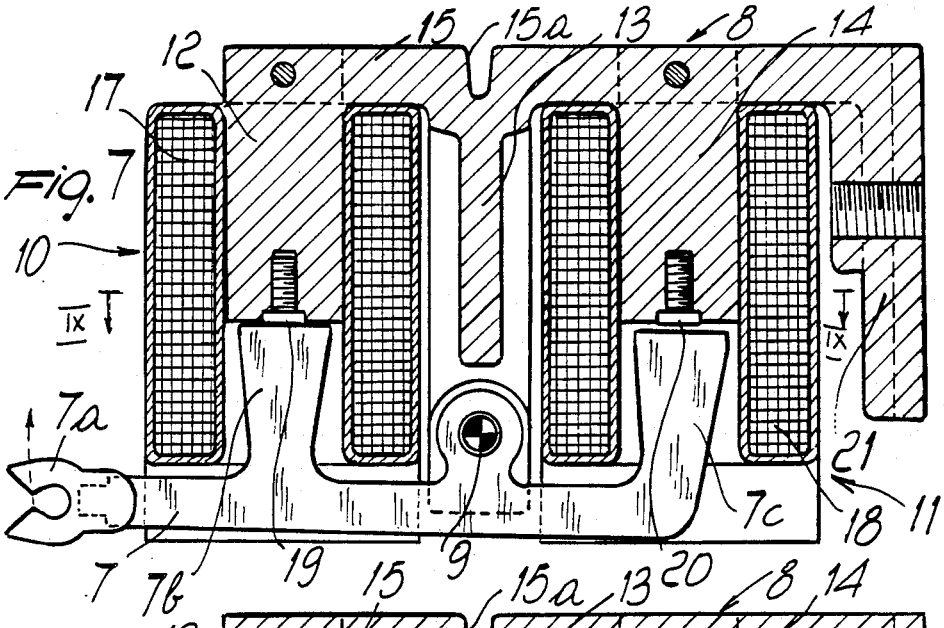
FIG. 7 is an enlarged lateral elevation view of two electromagnets and an actuating lever in an operating position.
Figure 8:
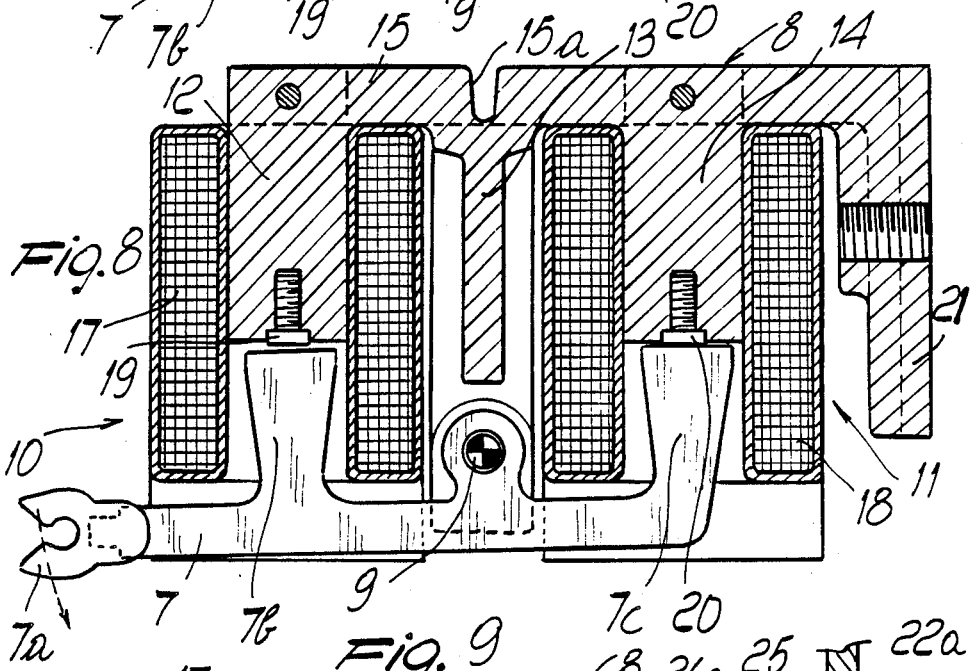
FIG. 8 is an enlarged lateral elevation view of two electromagnets and an actuating lever in another operating position.
Figure 9:
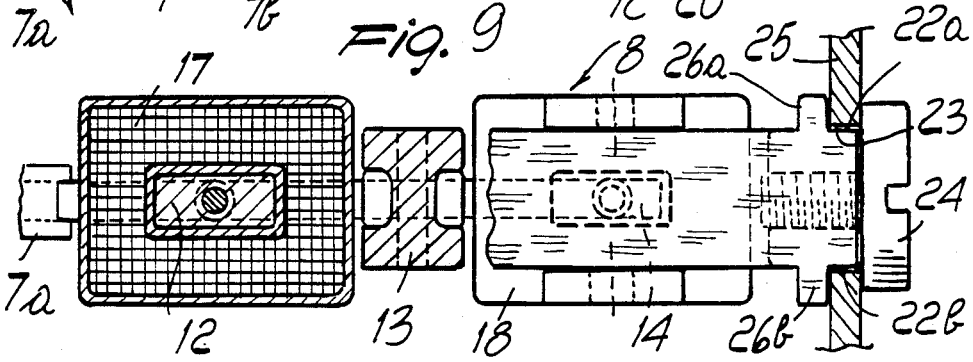
FIG. 9 is a cross section view of FIG. 7 along the axis IX—IX.

The selection levers each have an end 2*a* facing the needle-bearing cylinder 4 in the region of the selectors 5 or sub-needles; the selection levers can oscillate around the axis of their pivot 6 in a plane or selection plane Ps (FIG. 4) substantially parallel to the direction of sliding of the selectors, so that their end 2*a* can pass from a first position, whereat it is positioned at a level comprised between the heels 5*a* of the selectors, so as to not interfere therewith, to a second position, wherein it is positioned at the level of the heels 5*a* of the selectors so as to interfere therewith, pushing them into the grooves 4*a* of the needle-bearing cylinder to perform a selection among the selectors.

On the end 2*b* of each selection lever, which is located on the opposite side with respect to the selector and which is advantageously in the shape of a flat blade arranged perpendicular with respect to the plane of oscillation of the selection levers, there engages an end 7*a* of an actuating lever 7 which is bifurcated to engage both sides of the blade. The actuating lever 7 is pivoted at an intermediate portion thereof to a frame 8 which is in turn fixed to the supporting framework 3.

According to the invention, the control lever can oscillate about its fulcrum 9 in a plane substantially parallel to the plane Ps of oscillation of the selection levers so as to move, by virtue of its oscillation, the related selection lever from the first position to the second position, or vice versa, and two electromagnets 10 and 11, arranged on opposite sides with respect to the fulcrum 9, are provided for its operation.

Advantageously, the two electromagnets 10 and 11 are arranged on the same side with respect to the selection lever so as to limit the dimensions of the device in a direction parallel to the axis of the needle-bearing cylinder. The two electromagnets are furthermore provided with their axes parallel to one another and arranged perpendicular with respect to the longitudinal extension of the actuating lever.

Advantageously, the frame 8 is provided in a single piece of ferromagnetic material and has at least three portions, respectively 12, 13 and 14, which extend parallel to one another from a single base portion 15. The central portion 13 has a free end which is bifurcated and traversed by a hole 16 to accommodate a pivot which constitutes the fulcrum 9 of the actuating lever. Around the two portions 12 and 14, which extend laterally on opposite sides with respect to the central portion, the coils 17 and 18 are arranged, provided with a suitable insulating covering, and the portions 12 and 14 constitute the core of the electromagnets.

The actuating lever is furthermore provided, on opposite sides with respect to the fulcrum 9, with two expansions 7*b* and 7*c* which extend parallel to one another towards the cores of the electromagnets, penetrating the coils 17 and 18; to balance the forces exerted by the electromagnets on the actuating lever, the expansions 7*b* and 7*c* are equidistant from the fulcrum 9.

Advantageously, the base portion 15 is provided, at the central portion 13, with a weakened or narrower portion 15*a* which divides the frame 8 into two magnetic circuits, respectively composed of the portion 12, of the central portion 13 and a portion of the actuating lever consisting of the expansion 7*b*, and the portion 14, of the central portion 13 and a portion of the actuating lever consisting of the expansion 7*c*.

In order to avoid any sticking between the expansions 7*b* and 7*c* and the related core of the electromagnets, a pin 19 and 20 is provided on each core, defining a raised portion with respect to the remaining surface of the core.

Advantageously, the frame 8 is provided, at one of its ends, more precisely at the opposite end with respect to the bifurcated end 7*a* of the actuating lever, with a fourth expansion 21 which extends parallel to the other three portions 12, 13 and 14 and is provided with guide means to engage the frame 8 to the supporting framework 3.

The guiding means are substantially composed of a pair of mutually parallel surfaces 22*a* and 22*b* which extend parallel to the plane of oscillation of the actuating lever and are engageable with the sides of adapted slots 23 defined in the supporting framework. For the fixing of the frame 8 to the supporting framework, a screw 24 is provided which is screwed into the frame 8 and abuts with its head against a wall 25 of the supporting framework, tightening against the latter a pair of shoulders 26*a* and 26*b* of the frame 8.

For the operation of more selection levers, it is possible to arrange the actuating levers with the related frames side by side and mutually vertically offset so that each actuating lever is at the level of a selection lever. Furthermore, the electromagnets can be connected to an electronic control element, of a known type, not illustrated, which performs their actuation according to a preset processing program.

After what has been described, the operation of the device according to the invention is evident.

In order to obtain the passage of the selection levers 2 from the first position to the second position, the electronic control element of the machine activates the electromagnet 11 and deactivates the electromagnet 12 so as to cause the oscillation of the actuating lever 7 which acts on the related selection lever 2 making it oscillate indeed from the first position to the second position. To return the selection lever to the first position, the control element activates the electromagnet 10 and deactivates the electromagnet 11.

In practice it has been observed that the device according to the invention fully achieves the intended aim, since the use of two electromagnets for each actuating lever ensures high operating speeds and their arrangement allows to maintain reduced dimensions of the device both along a direction parallel to the needle-bearing cylinder and circumferentially.

A further advantage resides in the possibility of supplying the electromagnets with rather high voltages at the beginning of the activation to achieve a high response speed and of reducing this voltage to minimal values after the activation (sustaining voltage) so as to cause no appreciable heating of the coils; in this manner the use of voltage stabilizers becomes useless. In the course of experiments, the device allowed to achieve, for example, an actuating lever response speed such as to provide an oscillation every 1.5 milliseconds for an operating timespan typical of knitting machines without causing appreciable heating of the coils.

The particular embodiment of the frame which supports the electromagnets, besides achieving an excellent containment of dimensions, also allows a very precise processing and assembly and ensures an excellent repeatability in manufacture.

A further advantage is due to the ease in assembly and in adjustment of the frame by virtue of the guiding means.

The device thus conceived is susceptible to numerous modifications and variations, all of which are within the scope of the inventive concept; moreover, all the details may be replaced with technically equivalent elements.

In practice, the materials employed, so long as compatible with the specific use, as well as the dimensions, may be any according to requirements and the state of the art.

I claim:

1. Device for selecting needles in a circular knitting machine, in particular for stockings, comprising a plurality of superimposed selection levers individually pivoted at an intermediate portion thereof to a supporting structure, said selection levers each having one of its ends facing the needle-bearing cylinder in the region of the selectors and being oscillatable in a selection plane from a first position, whereat said end is at an intermediate level between the heels of the selectors so as to not interfere therewith, to a second position, whereat said end is at the level of the heels of the selectors so as to interfere therewith, an actuating lever being provided for each selection lever, acting on the opposite end of said selection lever with respect to said selectors for its passage from said first position to said second position, wherein said actuating lever has at an intermediate portion thereof a fulcrum, said actuating lever being pivoted at said fulcrum to a frame and controllably oscillable in an actuation plane, and wherein said device comprises two electromagnets arranged on opposite sides with respect to said fulcrum of said actuating lever, said electromagnets having cores and being selectively activatable for causing oscillation of said actuating lever, wherein said frame has a base portion, at least one central portion, and at least two other portions, said central portion and said two other portions extending parallel to each other from said base portion of said frame, said central portion oscillably supporting said actuating lever, said other two portions defining said cores of said electromagnets, said base portion having a reduced thickness at said central portion to define at least two magnetic circuits in said frame.

2. A device according to claim 1, wherein said frame is made monolithically of ferromagnetic material.

3. A device according to claim 1, wherein said actuating lever has at least two expansions, said expansions extending substantially parallel to each other in a transverse direction towards said cores of said electromagnets.

4. A device according to claim 1, wherein said actuating lever has at least two expansions, said at least two expansions extending substantially parallel to each other in a transverse direction towards said cores of said electromagnets and being equidistantly spaced from said fulcrum.

5. A device according to claim 3, wherein said actuating lever has at least one side and at least one other side, said electromagnets being located proximate to said at least one side of said actuating lever and adapted for cooperation with said expansions.

6. A device according to claim 1, wherein said base portion has an end, and wherein said frame has a fourth portion, said fourth portion extending substantially parallel to said central portion and said at least two other portions and being arranged at said end of said base portion, said fourth portion having guiding means, said guiding means being adapted for coupling with said supporting structure.

7. A device according to claim 1, wherein said base portion has an end, and wherein said frame has a fourth portion, said fourth portion extending substantially parallel to said central portion and said at least two other portions and being arranged at said end of said base portion, said fourth portion having guiding means, said guiding means being adapted for coupling with said supporting structure and extending substantially parallel to said actuation plane.

8. Device for selecting needles in a circular knitting machine, in particular for stockings, comprising a plurality of superimposed selection levers individually pivoted at an intermediate portion thereof to a supporting structure, said selection levers each having one of its ends facing the needle-bearing cylinder in the region of the selectors and being oscillable in a selection plane from a first position, whereat said end is at an intermediate level between the heels of the selectors so as to not interfere therewith, to a second position, whereat said end is at the level of the heels of the selectors so as to interfere therewith, an actuating lever being provided for each selection lever, acting on the opposite end of said selection lever with respect to said selectors for its passage from said first position to said second position, wherein said actuating lever has at an intermediate portion thereof a fulcrum, said actuating lever being pivoted at said fulcrum to a frame and controllably oscillable in an actuation plane, and wherein said device comprises two electromagnets arranged on opposite sides with respect to said fulcrum of said actuating lever, said electromagnets having cores and being selectively activatable for causing oscillation of said actuating lever, wherein said actuating lever has at least two expansions, said expansions extending substantially parallel to each other and towards said cores of said electromagnets.

9. A device according to claim 8, wherein said frame has a base portion, a central portion, and at least two other portions, said central portion and said two other portions extending parallel to each other from said base portion of said frame, said central portion oscillably supporting said actuating lever, said other two portions defining said cores of said electromagnets, said base portion having a reduced thickness at said central portion to define two magnetic circuits in said frame.

10. A device according to claim 8, wherein said frame is made monolithically of ferromagnetic material.

11. A device according to claim 8, wherein said at least two expansions extend substantially parallel to each other in a transverse direction towards said cores of said electromagnets and are equidistantly spaced from said fulcrum.

12. A device according to claim 8, wherein said actuating lever has at least one side and at least one other side, said electromagnets being located proximate to said at least one side of said actuating lever and adapted for cooperation with said expansions.

13. A device according to claim 9, wherein said base portion has an end, and wherein said frame has a fourth portion, said fourth portion extending substantially parallel to said central portion and said at least two other portions and being arranged at said end of said base portion, said fourth portion having guiding means, said guiding means being adapted for coupling with said supporting structure.

14. A device according to claim 9, wherein said base portion has an end, and wherein said frame has a fourth portion, said fourth portion extending substantially parallel to said central portion and said at least two other portions and being arranged at said end of said base portion, said fourth portion having guiding means, said guiding means being adapted for coupling with said supporting structure and extending substantially parallel to said actuation plane.

15. Device for selecting needles in a circular knitting machine, in particular for stockings, comprising a plurality of superimposed selection levers individually pivoted at an intermediate portion thereof to a supporting structure, said selection levers each having one of its ends facing the needle-bearing cylinder in the region of the selectors and being oscillable in a selection plane from a first position, whereat said end is at an intermediate level between the heels of the selectors so as to not interfere therewith, to a second position, whereat said end is at the level of the heels of the selectors so as to interfere therewith, an actuating lever being provided for each selection lever, acting on the opposite end of said selection lever with respect to said selectors for its passage from said first position to said second position, wherein said actuating lever has at an intermediate portion thereof a fulcrum, said actuating lever being pivoted at said fulcrum to a frame and controllably oscillable in an actuation plane, and wherein said device comprises two electromagnets arranged on opposite sides with respect to said fulcrum of said actuating lever, said electromagnets having cores and being selectively activatable for causing oscillation of said actuating lever, wherein said frame has a base portion, at least one central portion, and at least two other portions, said central portion and said two other portions extending parallel to each other from said base portion of said frame, said central portion oscillably supporting said actuating lever, said other two portions defining said cores of said electromagnets, said actuating lever having at least two expansions, said expansions extending substantially parallel to each other and towards said cores of said electromagnets.

16. A device according to claim 15, wherein said frame is made monolithically of ferromagnetic material.

17. A device according to claim 15, wherein said at least two expansions extend substantially parallel to each other in a transverse direction towards said cores of said electromagnets and are equidistantly spaced from said fulcrum.

18. A device according to claim 15, wherein said actuating lever has at least one side and at least one other side, said electromagnets being located proximate to said at least one side of said actuating lever and adapted for cooperation with said expansions.

19. A device according to claim 15, wherein said base portion has an end, and wherein said frame has a fourth portion, said fourth portion extending substantially parallel to said central portion and said at least two other portions and being arranged at said end of said base portion, said fourth portion having guiding means, said guiding means being adapted for coupling with said supporting structure.

20. A device according to claim 15, wherein said base portion has an end, and wherein said frame has a fourth portion, said fourth portion extending substantially parallel to said central portion and said at least two other portions and being arranged at said end of said base portion, said fourth portion having guiding means, said guiding means being adapted for coupling with said supporting structure and extending substantially parallel to said actuation plane.

* * * * *